US010690007B2

(12) United States Patent
Quennehen et al.

(10) Patent No.: US 10,690,007 B2
(45) Date of Patent: Jun. 23, 2020

(54) TURBINE RING ASSEMBLY WITH AXIAL RETENTION

(71) Applicants: SAFRAN AIRCRAFT ENGINES, Paris (FR); SAFRAN CERAMICS, Le Haillan (FR)

(72) Inventors: Lucien Henri Jacques Quennehen, Moissy-Cramayel (FR); Sebastien Serge Francis Congratel, Moissy-Cramayel (FR)

(73) Assignees: SAFRAN AIRCRAFT ENGINES, Paris (FR); SAFRAN CERAMICS, Le Haillan (FR)

( * ) Notice: Subject to any disclaimer, the term of this patent is extended or adjusted under 35 U.S.C. 154(b) by 200 days.

(21) Appl. No.: 15/576,014

(22) PCT Filed: May 12, 2016

(86) PCT No.: PCT/FR2016/051123
§ 371 (c)(1),
(2) Date: Nov. 21, 2017

(87) PCT Pub. No.: WO2016/189215
PCT Pub. Date: Dec. 1, 2016

(65) Prior Publication Data

US 2018/0156069 A1 Jun. 7, 2018

(30) Foreign Application Priority Data

May 22, 2015 (FR) ..... 15 54604

(51) Int. Cl.
*F01D 25/24* (2006.01)
*F01D 11/08* (2006.01)

(52) U.S. Cl.
CPC ..... *F01D 25/246* (2013.01); *F01D 11/08* (2013.01); *F05D 2230/60* (2013.01); *F05D 2240/11* (2013.01); *F05D 2300/6033* (2013.01)

(58) Field of Classification Search
CPC ..... F01D 25/246; F01D 11/08; F01D 11/12; F01D 1/025; F01D 11/22; F01D 11/18;
(Continued)

(56) References Cited

U.S. PATENT DOCUMENTS 4,596,116 A 6/1986 Mandet et al.
4,688,988 A 8/1987 Olsen
(Continued)

FOREIGN PATENT DOCUMENTS

GB 2 169 356 A 7/1986

OTHER PUBLICATIONS

International Search Report dated Jul. 28, 2016 in PCT/FR2016/051123 filed May 12, 2016.

*Primary Examiner* — Kenneth J Hansen
*Assistant Examiner* — Andrew J Marien
(74) *Attorney, Agent, or Firm* — Oblon, McClelland, Maier & Neustadt, L.L.P.

(57) ABSTRACT

A turbine ring assembly includes both a plurality of ring sectors made of ceramic matrix composite material forming a turbine ring and also a ring support structure having two annular flanges, each ring sector having two tabs held respectively between the two annular flanges of the ring support structure. The two annular flanges of the ring support structure exert stress on the tabs of the ring sectors. One of the flanges of the ring support structure is elastically deformable in the axial direction of the turbine ring. The turbine ring assembly further includes a plurality of pegs
(Continued)

engaged both in the annular flanges of the ring support structure and in the tabs of the ring sectors facing the annular flanges.

4 Claims, 3 Drawing Sheets

(58) Field of Classification Search
CPC ..... F05D 2300/6033; F05D 2230/60; F05D 2240/11
USPC ..... 415/173.4
See application file for complete search history.

(56) References Cited

U.S. PATENT DOCUMENTS

| | | | | |
|---|---|---|---|---|
| 5,330,321 | A * | 7/1994 | Roberts | F01D 11/18 415/136 |
| 2004/0219011 | A1* | 11/2004 | Albers | F01D 11/16 415/174.2 |
| 2006/0292001 | A1 | 12/2006 | Keller et al. | |
| 2016/0305265 | A1* | 10/2016 | Stapleton | F04D 29/321 |
| 2017/0167279 | A1* | 6/2017 | Kirby | F01D 11/001 |

* cited by examiner

TURBINE RING ASSEMBLY WITH AXIAL RETENTION

BACKGROUND OF THE INVENTION

The invention relates to a turbine ring assembly for a turbine engine, which assembly comprises a plurality of single-piece ring sectors made of ceramic matrix composite material together with a ring support structure.

The field of application of the invention lies in particular in gas turbine aeroengines. Nevertheless, the invention is applicable to other turbine engines, e.g. industrial turbines.

Ceramic matrix composite (CMC) materials are known for their good mechanical properties, which makes them suitable for constituting structural elements, and for their ability to conserve those properties at high temperatures.

In gas turbine aeroengines, improving efficiency and reducing polluting emissions lead to seeking to operate at ever higher temperatures. In turbine ring assemblies that are made entirely out of metal, it is necessary to cool all of the elements of the assembly, and in particular the turbine ring, which is subjected to high-temperature streams. Such cooling has a significant impact on the performance of the engine since the cooling stream is taken from the main stream through the engine. In addition, the use of metal for the turbine ring limits potential for increasing temperature in the turbine, even though that would make it possible to improve the performance of aeroengines.

The use of CMCs for various hot portions of such engines has already been envisaged, particularly since CMCs present density that is lower than that of the refractory metals that are conventionally used.

Thus, making single-piece turbine ring sectors out of CMC is described in particular in Document US 2012/0027572. The ring sectors comprise an annular base having an inner face defining the inside face of the turbine ring and an outer face from which there extend two tab-forming portions having their ends engaged in housings of a metal structure of the ring support.

The use of CMC ring sectors serves to reduce significantly the amount of ventilation that is needed for cooling the turbine ring. Nevertheless, sealing between the gas flow passage on the inside of the ring sectors and the outside of the ring sectors remains a problem. Specifically, in order to ensure good sealing, it is necessary to be able to ensure good contact between the tabs of the CMC ring sectors and the metal flanges of the ring support structure. Unfortunately, differential expansion between the metal of the ring support structure and the CMC of the ring sectors complicates maintaining sealing between those elements. Thus, in the event of differential expansion and depending on the mounting geometry of the ring sectors on the ring support structure, the flanges of the ring support structure might no longer be in contact with the tabs of the sectors, or on the contrary they might exert stress that is too strong on the tabs of the sectors, which can damage them. In addition, as described in Document US 2012/0027572, holding the ring sectors on the ring support structure requires the use of a clamp of U-shaped section which makes mounting the sectors more complicated and increases the cost of the assembly.

Documents U.S. Pat. Nos. 4,596,116 and 4,087,199 disclose a turbine ring assembly in which the ring sectors are held axially between tabs of a ring support structure. Nevertheless, the solution for attaching the ring sectors disclosed in those documents do not make it possible to prevent the ring sectors from moving or sliding in the radial and circumferential directions of the ring, which can be problematic, in particular in the event of contact between the tip of a rotating blade and the inside surface of one or more ring sectors.

OBJECT AND SUMMARY OF THE INVENTION

The invention seeks to avoid such drawbacks and for this purpose it proposes a turbine ring assembly comprising both a plurality of ring sectors forming a ring and also a ring support structure having two annular flanges, each ring sector having a first portion forming an annular base with an inner face defining the inside face of the turbine ring and an outer face from which two tabs extend radially, the tabs of each ring sector being held between the two annular flanges of the ring support structure, the two annular flanges of the ring support structure exerting stress on the tabs of the ring sectors, at least one of the flanges of the ring support structure being elastically deformable in the axial direction of the ring, the turbine ring assembly being characterized in that each ring sector is made of ceramic matrix composite material and in that it further comprises a plurality of pegs engaged both in at least one of the annular flanges of the ring support structure and in the tabs of the ring sectors facing said at least one annular flange.

The presence of pegs makes it possible to ensure that the ring sectors are held radially and circumferentially in position on the ring support structure. Specifically, since the pegs are engaged both in at least one annular flange of the ring support structure and in the tabs of the ring sectors facing the flange in question, it is possible to prevent any sliding or potential movement of the ring sectors in the circumferential and radial directions of the ring relative to the ring support structure, even in the event of contact between the tip of a rotating blade and one or more ring sectors.

Furthermore, because of the presence of at least one elastically deformable flange, contact between the flanges of the ring support structure and the tabs of the ring sectors can be maintained independently of temperature variations. Specifically, the ring sectors may be mounted between the flanges with prestress while "cold", such that contact between the ring sectors and the flanges is ensured regardless of temperature conditions. The flexibility of at least one of the flanges of the ring support structure makes it possible by deforming to accommodate differential thermal expansion between the ring sectors and the flanges so as to avoid exerting excessive stress on the ring sectors.

In a first aspect of the turbine ring assembly of the invention, at least one of the annular flanges of the ring support structure includes a lip on its face facing the tabs of the ring sectors. The presence of a lip on a flange serves to facilitate defining the contact portion between the flange of the ring support structure and the tabs of the ring sectors facing it.

In a second aspect of the turbine ring assembly of the invention, the elastically deformable flange of the ring support structure has a plurality of hooks distributed over its face opposite from its face facing the tabs of the ring sectors. The presence of hooks makes it possible to facilitate moving the elastically deformable flange away in order to insert the tabs of the ring sectors between the flanges without needing to force the tabs to slide between the flanges.

In a third aspect of the turbine ring assembly of the invention, each elastically deformable flange of the ring support structure presents thickness that is less than the thickness of the other flange of said ring support structure.

The present invention also provides a method of making a turbine ring assembly, the method comprising:

fabricating a plurality of ring sectors, each ring sector having a first portion forming an annular base with an inner face defining the inside face of the turbine ring and an outer face from which two tabs extend radially;

fabricating a ring support structure having two annular flanges; and mounting each ring sector between the two annular flanges of the ring support structure, the spacing between the two flanges of the ring support structure being smaller than the distance between the outer faces of the tabs of each ring sector, at least one of the flanges of the ring support structure being elastically deformable in the axial direction of the ring, the method being characterized in that during mounting of each ring sector, traction is exerted in the axial direction of the ring on said elastically deformable flange so as to increase the spacing between the two flanges and engage the tabs of the ring sector between the two flanges of the ring support structure, in that each ring sector is made of ceramic matrix composite material, and in that the method further comprises engaging a plurality of pegs both in at least one of the annular flanges of the ring support structure and in the tabs of the ring sectors facing said at least one annular flange.

The use of blocking pegs makes it possible to ensure that the ring sectors are held in radial and circumferential positions on the ring support structure. Specifically, since the pegs are engaged both in at least one annular flange of the ring support structure and in the tabs of the ring sectors facing the flange in question, it is possible to prevent any sliding or potential movement of the ring sectors in the circumferential and radial directions of the ring relative to the ring support structure, even in the event of contact between the tip of a rotating blade and one or more ring sectors.

In addition, because of the traction exerted on the elastically deformable tab, it is possible to insert the tabs of the ring sectors between the flanges of the ring support structure without needing to apply force to said tabs, which are subsequently held axially with stress between the flanges after release of the traction that was exerted on the elastically deformable flange.

In a first aspect of the method of the invention for making a turbine ring assembly, at least one of the annular flanges of the ring support structure includes a lip on its face facing the tabs of the ring sectors.

In a second aspect of the method of the invention for making a turbine ring assembly, the elastically deformable flange of the ring support structure includes a plurality of hooks distributed over its face opposite from its face facing the tabs of the ring sectors, traction being exerted in the axial direction of the ring on said elastically deformable flange by a tool engaged in one or more hooks.

In a third aspect of the method of the invention for making a turbine ring assembly, the elastically deformable flange of the ring support structure presents thickness that is less than the thickness of the other flange of said ring support structure.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
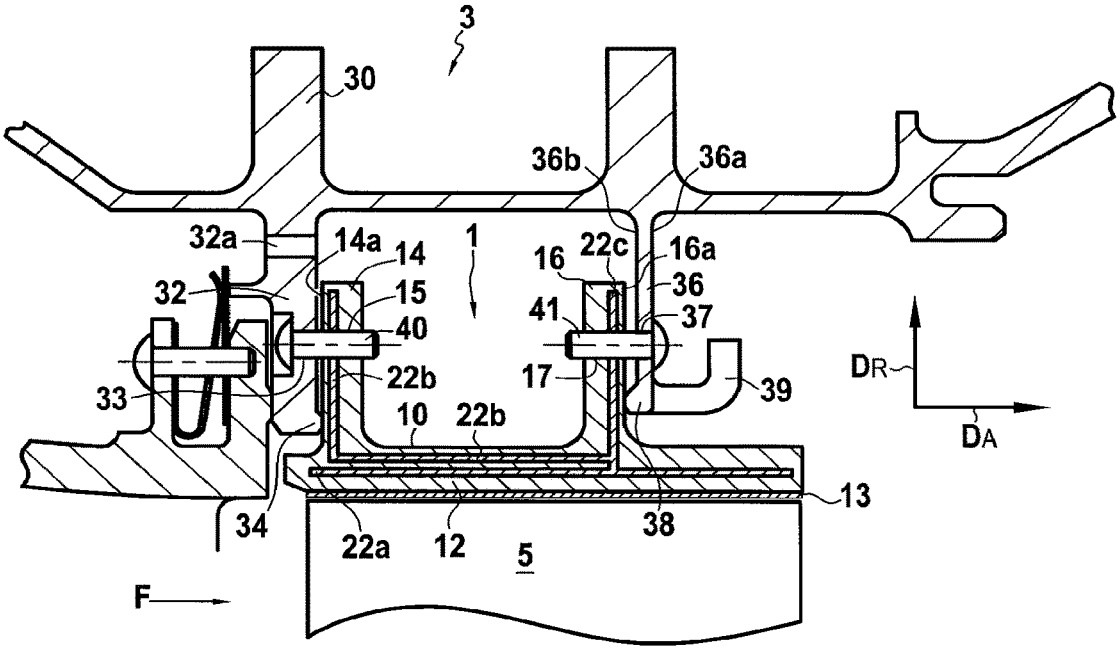
FIG. 1 is a radial half-section view showing an embodiment of a turbine ring assembly of the invention.

FIG. 1 shows a ring assembly for a high-pressure turbine, the assembly comprising a turbine ring 1 made of ceramic matrix composite (CMC) material together with a metal ring support structure 3. The turbine ring 1 surrounds a set of rotary blades 5. The turbine ring 1 is made of a plurality of ring sectors 10, with FIG. 1 being a radial section view on a plane passing between two contiguous ring sectors. Arrow $D_A$ indicates the axial direction relative to the turbine ring 1, while arrow $D_R$ indicates the radial direction relative to the turbine ring 1.

Each ring sector 10 has a section that is substantially in the shape of an upside-down letter π, with an annular base 12 having its inner face coated in a layer 13 of abradable material and/or a thermal barrier defining the flow passage for the gas stream through the turbine. Upstream and downstream tabs 14 and 16 extend from the outer face of the annular base 12 in the radial direction $D_R$. The terms "upstream" and "downstream" are used herein relative to the flow direction of the gas stream through the turbine (arrow F).

The ring support structure 3, which is secured to a turbine casing 30, includes an annular upstream radial flange 36 having a lip 34 on its face facing the upstream tab 14 of the ring sectors 10, the lip 34 bearing against the outside faces 14*a* of the upstream tabs 14. On the downstream side, the ring support structure has an annular downstream radial flange 36 having a lip 38 on its face facing the downstream tabs 16 of the ring sectors 10, the lip 38 bearing against the outside faces 16*a* of the downstream tabs 16.

As explained below in detail, the tabs 14 and 16 of each ring sector 10 are mounted with prestress between the annular flanges 32 and 54 so that, at least when "cold", i.e. at an ambient temperature of about 20° C., but also at all operating temperatures of the turbine, the flanges exert stress on the tabs 14 and 16, and thus exert clamping of the sectors by the flanges. This stress is maintained at all temperatures to which the ring assembly may be subjected while the turbine is in operation and, because of the presence of at least one elastically deformable flange, as explained above, it is under control, i.e. there is no excessive stress on the ring sectors.

Furthermore, in the presently-described example, the ring sectors 10 are also held by blocking pegs. More precisely, and as shown in FIG. 1, pegs 40 are engaged both in the annular upstream radial flange 32 of the ring support structure 3 and in the upstream tabs 14 of the ring sectors 10. For this purpose, each peg 40 passes through a respective orifice 33 formed in the annular upstream radial flange 32 and a respective orifice 15 formed in an upstream tab 14, the orifices 33 and 15 being put into alignment when mounting the ring sectors 10 on the ring support structure 3. Likewise, pegs 41 are engaged both in the annular downstream radial flange 36 of the ring support structure 3 and in the downstream tabs 16 of the ring sectors 10. For this purpose, each peg 41 passes through a respective orifice 37 formed in the annular downstream radial flange 36 and a respective orifice 17 formed in a downstream tab 16, the orifices 37 and 17 being put into alignment when mounting the ring sectors 10 on the ring support structure 3. The presence of pegs makes it possible to ensure that the ring sectors are held in position radially and circumferentially on the ring support structure. Specifically, since the pegs are engaged both in at least one annular flange of the ring support structure and in the tabs of the ring sectors facing the flange in question, it is possible to prevent any potential sliding or movement of the ring sectors in the circumferential and radial directions of the ring relative to the ring support structure, even in the event of contact being made between the tip of a rotating blade and one or more ring sectors.

Furthermore, sealing between sectors is provided by sealing tongues received in grooves that face each other in the facing edges of two neighboring ring sectors. A tongue 22*a* extends over nearly all of the length of the annular base 12 in the middle portion thereof. Another tongue 22*b* extends along the tab 14 and over a portion of the annular base 12. Another tongue 22*c* extends along the tab 16. At one end, the tongue 22*c* comes into abutment against the tongue 22*a* and against the tongue 22*b*. The tongues 22*a*, 22*b*, and 22*c* are made of metal for example and they are mounted without clearance when cold in their housings so as to ensure that the sealing function is provided at the temperatures encountered in service.

Assembling the tabs 14 and 16 of the CMC ring sector without clearance relative to the metal portions of the ring support structure is made possible in spite of the difference in coefficients of thermal expansion because:

- this assembling is performed at a distance from the hot face of the annular base 12 that is exposed to the gas stream;
- the tabs 14 and 16 advantageously present a length in radial section that is relatively long compared with their mean thickness, such that effective thermal decoupling is obtained between the annular base 12 and the ends of the tabs 14 and 16; and
- one of the flanges of the ring structure is elastically deformable, thereby making it possible to compensate differential expansion between the tabs of the CMC ring sectors and the flanges of the metal ring support structure without significantly increasing the stress that is exerted "cold" by the flanges on the tabs of the ring sectors.

In addition, in conventional manner, ventilation orifices 32*a* formed in the flange 32 enable cooling air to be delivered to cool the outside of the turbine ring 10.

There follows a description of a method of making a turbine ring assembly corresponding to the assembly shown in FIG. 1.

Each above-described ring sector 10 is made of ceramic matrix composite (CMC) material by forming a fiber preform of shape close to the shape of the ring sector and by densifying the ring sector with a ceramic matrix.

In order to make the fiber preform, it is possible to use yarns made of ceramic fibers, e.g. SiC fiber yarns such as those sold by the Japanese supplier Nippon Carbon under the name "Nicalon", or yarns made of carbon fibers.

The fiber preform is advantageously made by three-dimensional weaving or by multilayer weaving, with zones of non-interlinking being arranged to allow the portions of the preforms that correspond to the tabs 14 and 16 to be moved away from the sectors 10.

The weaving may be of the interlock type as shown. Other three-dimensional or multilayer weaves may be used, such as for example multi-plain or multi-satin weaves. Reference may be made to Document WO 2006/136755.

After weaving, the blank may be shaped in order to obtain a ring sector preform that is consolidated and densified with a ceramic matrix, it being possible for densification to be performed in particular by chemical vapor infiltration (CVI) or by melt infiltration (MI) in which liquid silicon is introduced into the fiber preform by capillarity, with the preform previously being consolidated by a stage of CVI, which methods are well known in themselves.

A detailed example of fabricating CMC ring sectors is described in particular in Document US 2012/0027572.

The ring support structure 3 is made of a metal material such as Inconel, the C263 superalloy, or Waspaloy®.

Figure 2:
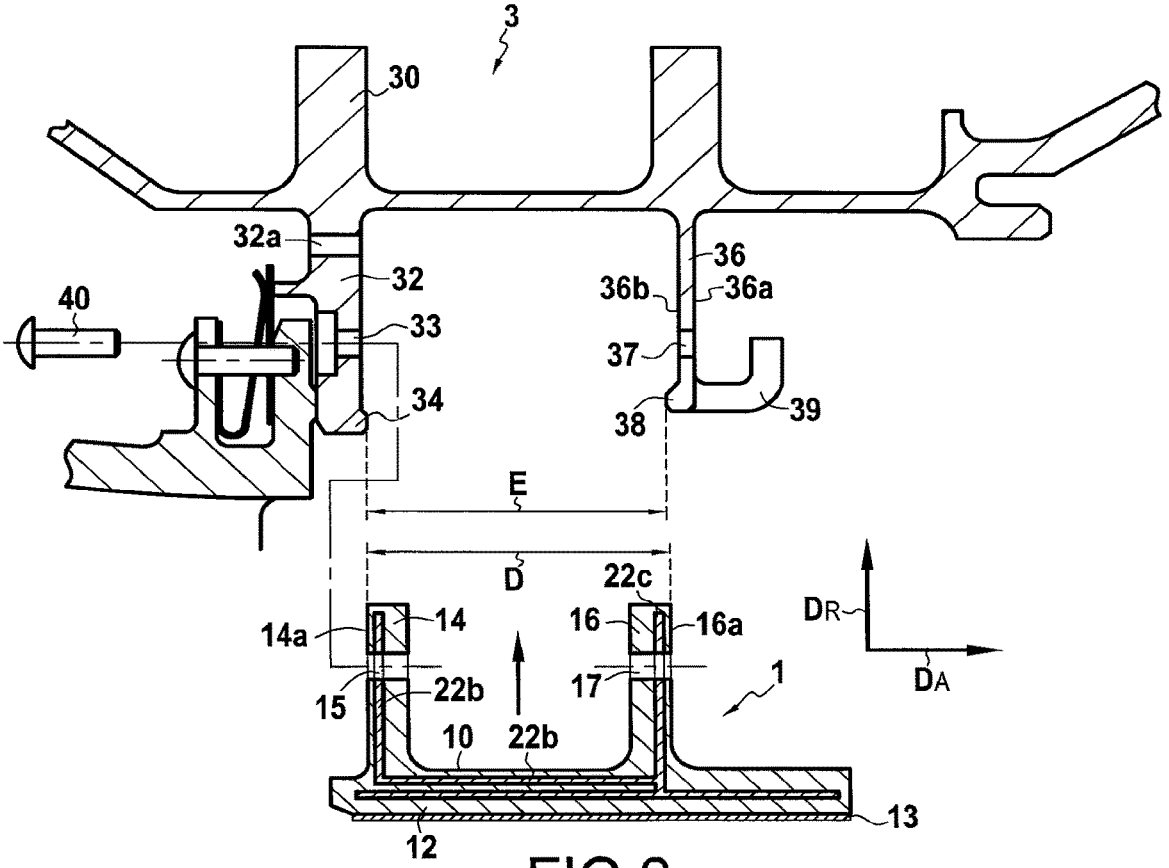
FIGS. 2 to 4 are diagrams showing how a ring sector is mounted in the ring support structure of the FIG. 1 ring assembly.

The making of the turbine ring assembly continues by mounting the ring sectors 10 on the ring support structure 3. As shown in FIG. 2, the spacing E between the annular upstream radial flange 32 and the annular downstream radial flange 36 when at "rest", i.e. when no ring sector is mounted between the flanges, is smaller than the distance D present between the outer faces 14*a* and 16*a* of the upstream and downstream tabs 14 and 16 of the ring sectors. In the presently-described example, the spacing E is measured between the lips 34 and 38 present respectively at the ends of the annular flanges 32 and 36. In embodiments of the turbine ring assembly of the invention in which the annular flanges do not include lips, the spacing is measured between the inner faces of the flanges that come into contact with the outer surfaces of the tabs of the ring sectors.

By defining a spacing E between the flanges of the ring support structure that is smaller than the distance D between the outer faces of the tabs of each ring sector, it is possible to mount the ring sectors with prestress between the flanges of the ring support structure. Nevertheless, in order to avoid damaging the tabs of the CMC ring sectors during mounting, and in accordance with the invention, the ring support structure includes at least one annular flange that is elastically deformable in the axial direction $D_A$ of the ring. In the presently-described example, it is the annular downstream radial flange 36 that is elastically deformable. Specifically, the annular downstream radial flange 36 of the ring support structure 3 presents thickness that is small compared with the annular upstream radial flange 32, and it is that which imparts a degree of resilience thereto.

Figure 3:
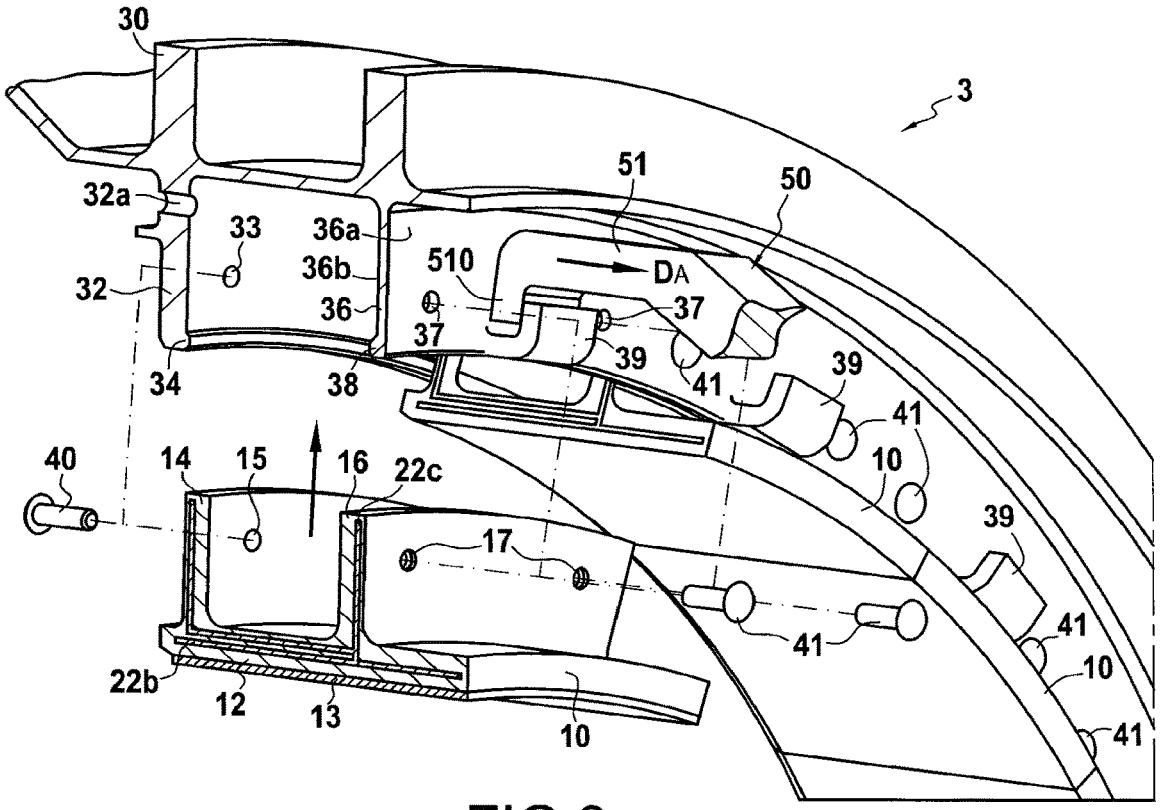
Figure 4:
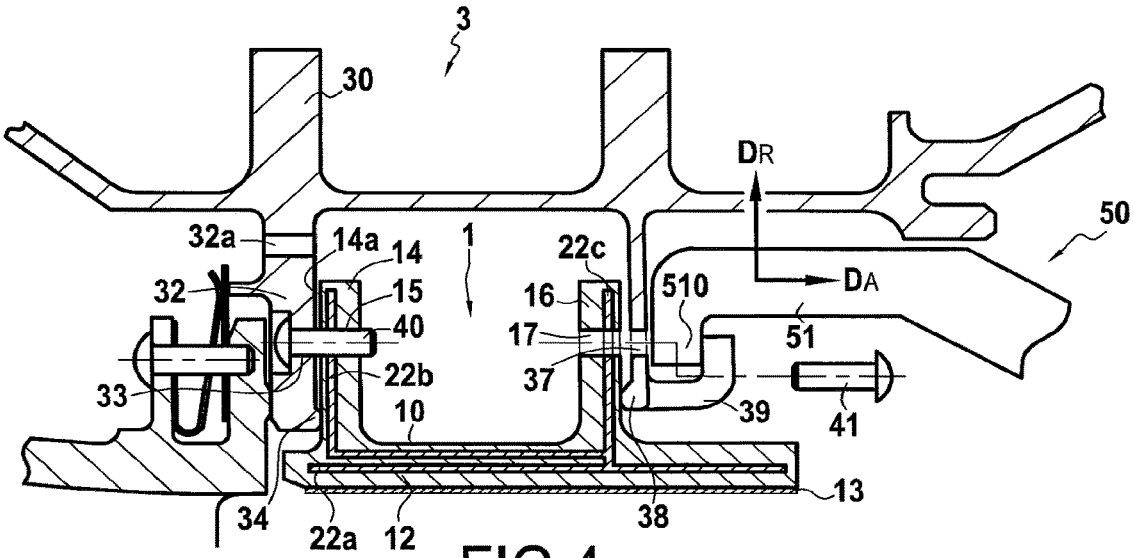

When mounting a ring sector 10, the annular downstream radial flange 36 is pulled in the direction $D_A$ as shown in FIGS. 3 and 4 in order to increase the spacing between the flanges 32 and 36 and allow the tabs 14 and 16 to be inserted between the flanges 32 and 36 without risk of damage. Once the tabs 14 and 16 of a ring sector 10 are inserted between the flanges 14 and 16 and positioned so as to align the orifices 33 and 15 and also the orifices 17 and 37, the flange 36 is released with the lips 34 and 38 of the respective flanges 32 and 36 then exerting a holding stress on the tabs 14 and 16 of the ring sector. In order to make it easier to move the annular downstream radial flange 36 away by applying traction, it includes a plurality of hooks 39 that are distributed over its face 36*a*, which face is opposite from the face 36*b* of the flange 36 facing the downstream tabs 16 of the ring sectors 10 (FIG. 4). The traction in the axial direction $D_A$ of the ring exerted on the elastically deformable flange 36 in this example is applied by means of a tool 50 having at least one arm 51 with its end including a hook 510 that is engaged in a hook 39 present on the outer face 36*a* of the flange 36.

The number of hooks 39 distributed over the face 36*a* of the flange 36 is defined as a function of the number of traction points it is desired to have on the flange 36. This number depends mainly on the elastic nature of the flange. It is naturally possible in the ambit of the present invention to envisage other shapes and arrangements of means enabling traction to be exerted in the axial direction $D_A$ on one of the flanges of the ring support structure.

Once the ring sector 10 is inserted and positioned between the flanges 32 and 36, pegs 40 are engaged in the aligned orifices 33 and 15 formed respectively in the annular upstream radial flange 32 and in the upstream tab 14, and pegs 41 are engaged in the aligned orifice 37 and 17 formed respectively in the annular downstream radial flange 36 and in the downstream tab 16. Each tab 14 or 16 of a ring sector may have one or more orifices for passing a blocking peg.

Figure 5:
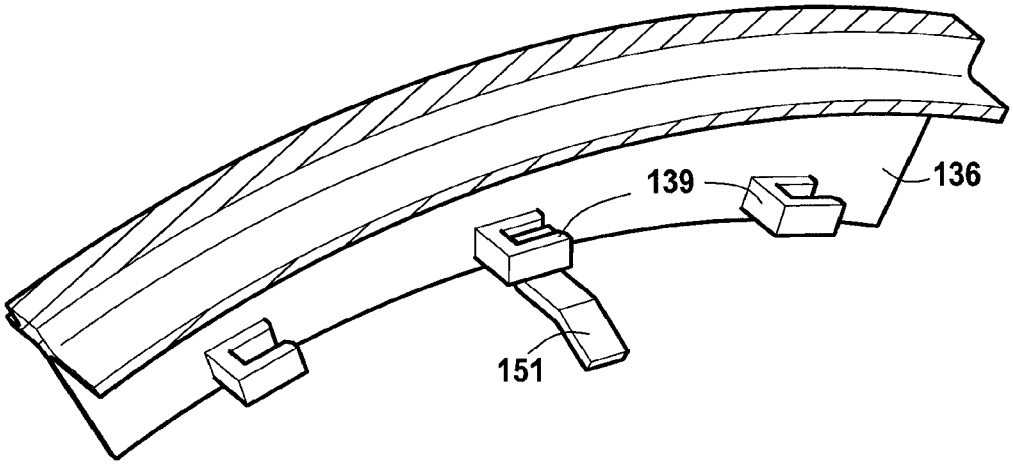
FIG. 5 is a diagrammatic perspective view showing a variant embodiment of hooks present on an elastically deformable flange of a ring support structure.
Figure 6:
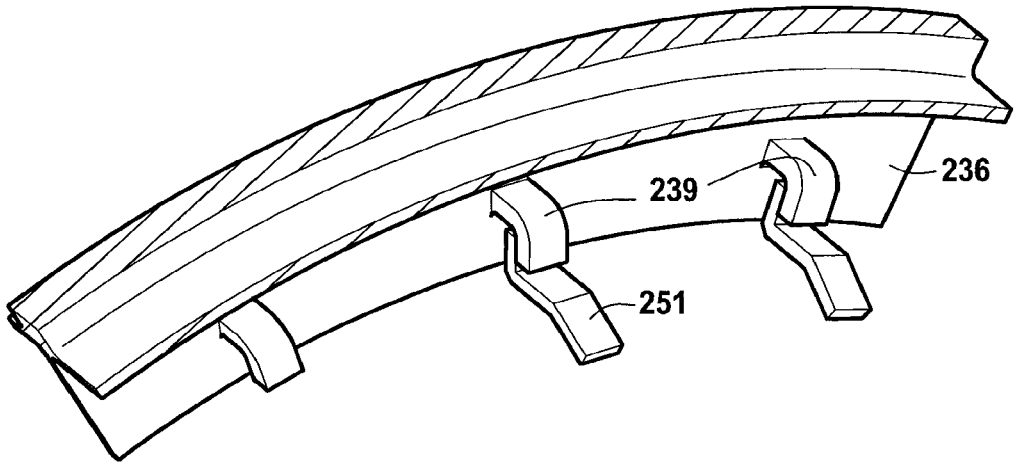
FIG. 6 is a diagrammatic perspective view showing another variant embodiment of hooks present on an elastically deformable flange of a ring support structure.

The shape and the orientation of the hooks may vary. FIG. 5 shows an annular downstream radial flange 136 having a plurality of hooks 139 that open in the circumferential direction of the flange and into which a tab 151 of traction tooling is inserted. FIG. 6 shows an annular downstream radial flange 236 having a plurality of hooks 239 that open in the radial direction towards the bottom of the flange and into which a tab 251 of traction tooling is inserted.

The invention claimed is:

1. A turbine ring assembly comprising:

a plurality of ring sectors forming a turbine ring; and a ring support structure having two annular flanges, wherein each of the plurality ring sectors has a first portion forming an annular base with an inner face defining an inside face of the turbine ring and an outer face from which two tabs extend radially, the two tabs of each of the plurality ring sectors are held between the two annular flanges of the ring support structure, a portion of the two annular flanges of the ring support structure respectively in contact with the two tabs to exert a stress on the two tabs of the ring sectors, wherein at least one of the two annular flanges of the ring support structure is elastically deformable in an axial direction of the turbine ring, wherein each ring sector is made of ceramic matrix composite material and includes a plurality of pegs engaged both in at least one of the two annular flanges of the ring support structure and in the tabs of the ring sectors facing said at least one of the two annular flanges, wherein the at least one elastically deformable flange of the ring support structure has a thickness that is less than a thickness of the other flange of said ring support structure, and wherein the at least one elastically deformable flange of the ring support structure has a plurality of hooks, the hooks being distributed over a face of the elastically deformable flange opposite from a face facing the tabs of the ring sectors.

2. The turbine ring assembly according to claim 1, wherein at least one of the annular flanges of the ring support structure includes a lip, the lip provided on a face of the at least one of the annular flanges that faces the tabs of the ring sectors.

3. A method of making a turbine ring assembly, the method comprising:

fabricating a plurality of ring sectors, each ring sector having a first portion forming an annular base with an inner face defining the inside face of a turbine ring and an outer face from which two tabs extend radially;

fabricating a ring support structure having two annular flanges;

mounting each ring sector between the two annular flanges of the ring support structure, a spacing between the two flanges of the ring support structure being smaller than a distance between outer faces of the two tabs of each ring sector such that a portion of the two annular flanges of the ring support structure is in contact with the outer faces of the two tabs to exert a stress on the two tabs, at least one of the two annular flanges of the ring support structure being elastically deformable in an axial direction of the turbine ring;

wherein each ring sector is made of ceramic matrix composite material, in that during mounting of each ring sector, traction is exerted in the axial direction of the turbine ring on said elastically deformable flange so as to increase the spacing between the two flanges and engage the tabs of the ring sector between the two flanges of the ring support structure, wherein the method further comprises engaging a plurality of pegs both in at least one of the annular flanges of the ring support structure and in the tabs of the ring sectors facing said at least one annular flange, wherein the at least one elastically deformable flange of the ring support structure has a thickness that is less than a thickness of the other flange of said ring support structure, and wherein the at least one elastically deformable flange of the ring support structure includes a plurality of hooks, the hooks being distributed over a face of the at least one elastically deformable flange opposite from a face facing the tabs of the ring sectors, traction being exerted in the axial direction of the ring on said at least one elastically deformable flange by a tool engaged in one or more of the plurality of hooks.

4. The method according to claim 3, wherein at least one of the annular flanges of the ring support structure includes a lip on a face of the at least one of the annular flange that is facing the tabs of the ring sectors.

* * * * *